US006574817B2

(12) United States Patent
Wu

(10) Patent No.: US 6,574,817 B2
(45) Date of Patent: Jun. 10, 2003

(54) COMPLEX TOOL KIT

(76) Inventor: Shu Te Wu, No. 6, Lane 176, Wu Fu Road, Wu Feng, Taichung Hsien (TW)

( * ) Notice: Subject to any disclaimer, the term of this patent is extended or adjusted under 35 U.S.C. 154(b) by 0 days.

(21) Appl. No.: 09/984,697

(22) Filed: Oct. 31, 2001

(65) Prior Publication Data

US 2002/0073490 A1 Jun. 20, 2002

(30) Foreign Application Priority Data

Dec. 18, 2000 (TW) ..... 89221935 U

(51) Int. Cl.[7] ..... B25B 13/00

(52) U.S. Cl. ..... 7/138; 7/118; 7/168; 81/440

(58) Field of Search ..... 7/138, 165, 167, 7/168, 170, 118; 81/177.4, 437, 438, 439, 440, 490; 59/7, 11; 29/243.54; 157/1.3

(56) References Cited

U.S. PATENT DOCUMENTS 4,103,378 A * 8/1978 Granados ..... 7/138
4,157,594 A * 6/1979 Raabe ..... 7/125
4,967,435 A * 11/1990 Seals ..... 7/139
5,140,736 A * 8/1992 Hsiao ..... 29/243.54
5,251,341 A * 10/1993 Seals ..... 7/138
5,655,242 A * 8/1997 Chuang ..... 7/138
5,711,042 A 1/1998 Chuang ..... 7/138
5,970,553 A * 10/1999 Lin ..... 7/143
6,044,508 A * 4/2000 Chuang ..... 7/138
6,112,351 A * 9/2000 Hawkins et al. ..... 7/138
6,286,168 B1 9/2001 Woodruff et al. ..... 7/138

* cited by examiner

*Primary Examiner*—Lee D. Wilson
*Assistant Examiner*—David B. Thomas
(74) *Attorney, Agent, or Firm*—Troxell Law Office PLLC

(57) ABSTRACT

Complex tool kit including a foldable tool assembly and another tool assembly. The foldable tool assembly includes a main body having a passage on top face and several tools one end of which is pivotally connected with one end of the main body, The tools can be folded and collectively arranged under the main body. The other tool assembly includes an elongated flat board body, a chain-disassembling mechanism disposed on the board body for disassembling/assembling a chain and a clamping mechanism disposed on the board body. The clamping mechanism defines a clamping hole adjustable in size for driving a nut. The board body of the other tool assembly is detachably fitted into the passage of the main body and connected with the foldable tool assembly.

24 Claims, 10 Drawing Sheets

COMPLEX TOOL KIT

BACKGROUND OF THE INVENTION

The present invention is related to a hand tool, and more particularly to a complex tool kit composed of two tool assemblies. The complex tool kit can be easily carried and used to drive screwed connecting members of a bicycle frame.

U.S. Pat. No. 5,711,042 discloses a tool combination for bicycle as shown in FIGS. 1 and 2. The tool combination includes two kits of foldable tools 10, 20 locked with each other by a fixing device 11. Each foldable tool kit has a main body 12, 22 and several tools pivotally connected with the main body 12, 22 by a bolt.

The tool kits are used to assemble/disassemble or repair or adjust the structure of the bicycle.

Many parts of the bicycle frame are fixed thereon by a set of screwed connecting members including a hexagonal bolt and a nut. The two tool kits are used to respectively drive the bolt and nut. However, the two tool kits 10, 20 have large volume and after connected by the fixing device 11, the volume will be even larger so that such tool kits can be hardly conveniently carried. Furthermore, multiple hexagonal wrenches 13~17 with different sizes are pivotally connected with one tool kit 10 for driving hexagonal bolts. Three fixing wrenches 23, 24, 25 with different sizes and two hexagonal wrenches 26, 27 are pivotally connected with the other tool kit 20 for driving nuts. However, the number of the fixing wrenches is limited so that they can drive only a few sizes of nuts and can be hardly applied to all kinds of nuts of the bicycle frame. Especially, in the case that a user himself/herself adds articles to the bicycle frame, the nuts used for such articles will have various sizes to which the fixing wrenches cannot be applied.

In addition, the above tool kits have another shortcoming as follows: It often takes place that the hexagonal wrench and fixing wrench suitable for a certain set of bolt and nut are mounted on the same tool kit 20. For example, the hexagonal wrench 26 and the fixing wrench 25 must be cooperatively used. At this time, it is impossible to at the same drive the bolt and the nut and only one of the bolt and nut can be driven. Under such circumstance, the bolt and nut are often synchronously driven and cannot be tightened or untightened. Also, it is quite inconvenient to use the chain-cutting tool 28 of the tool kits.

FIG. 3 shows another conventional tool 30 for bicycle. The tool 30 has multiple fitting holes 32 with different sizes. The top end of the tool 30 is detachably connected with a chain cutter 34. The number of the sizes of the fitting holes 32 is limited so that the tool 30 can be hardly applied to all sizes of nuts. Moreover, the tool is one-piece tool so that it is still impossible to drive the bolt at the same time and effectively tighten or untighten the screwed connecting members.

SUMMARY OF THE INVENTION

It is therefore a primary object of the present invention to provide a complex tool kit composed of two tool assemblies which have simple structure and can be easily carried.

It is a further object of the present invention to provide a complex tool kit composed of two tool assemblies which are able to effectively drive all screwed connecting members of the bicycle frame and assemble/disassemble the chain of the bicycle.

It is still a further object of the present invention to provide a complex tool kit which are applicable to all sizes of nuts of the bicycle frame.

The present invention can be best understood through the following description and accompanying drawings wherein:

DETAILED DESCRIPTION OF THE PREFERRED EMBODIMENTS

Figure 1:
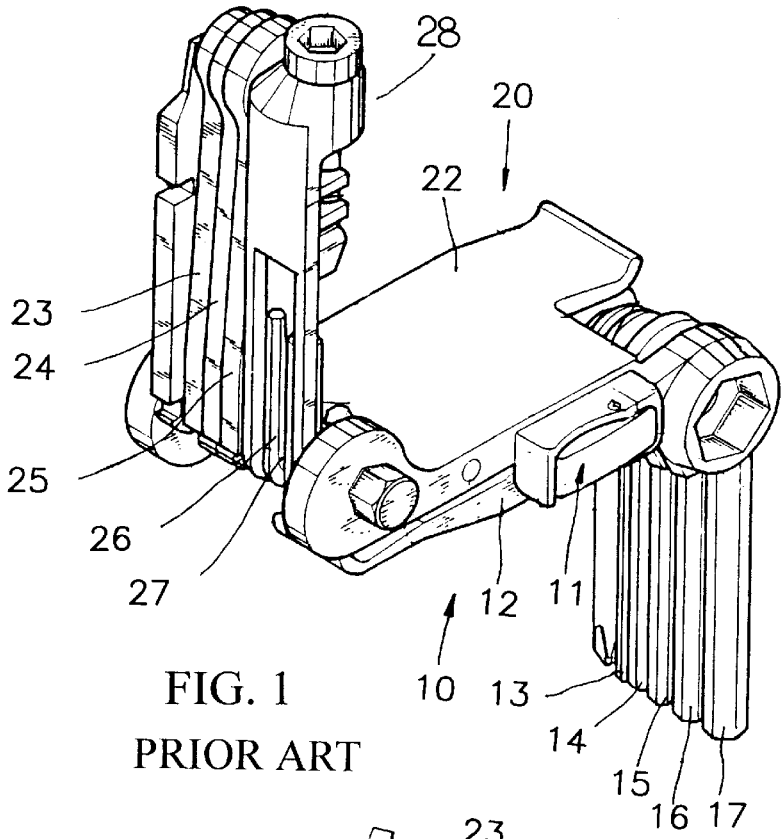
FIG. 1 PRIOR ART
FIG. 1 is a perspective assembled view of a conventional tool combination.
Figure 2:
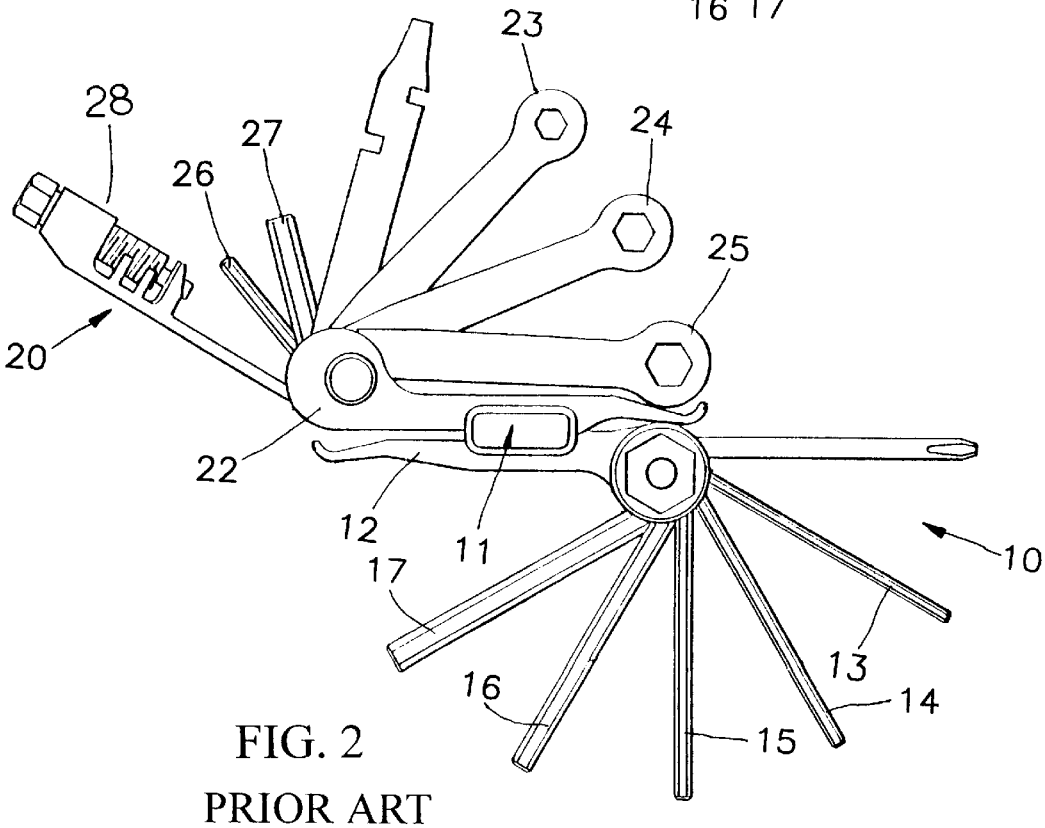
FIG. 2 PRIOR ART
FIG. 2 is a side view according to FIG. 1.
Figure 3:
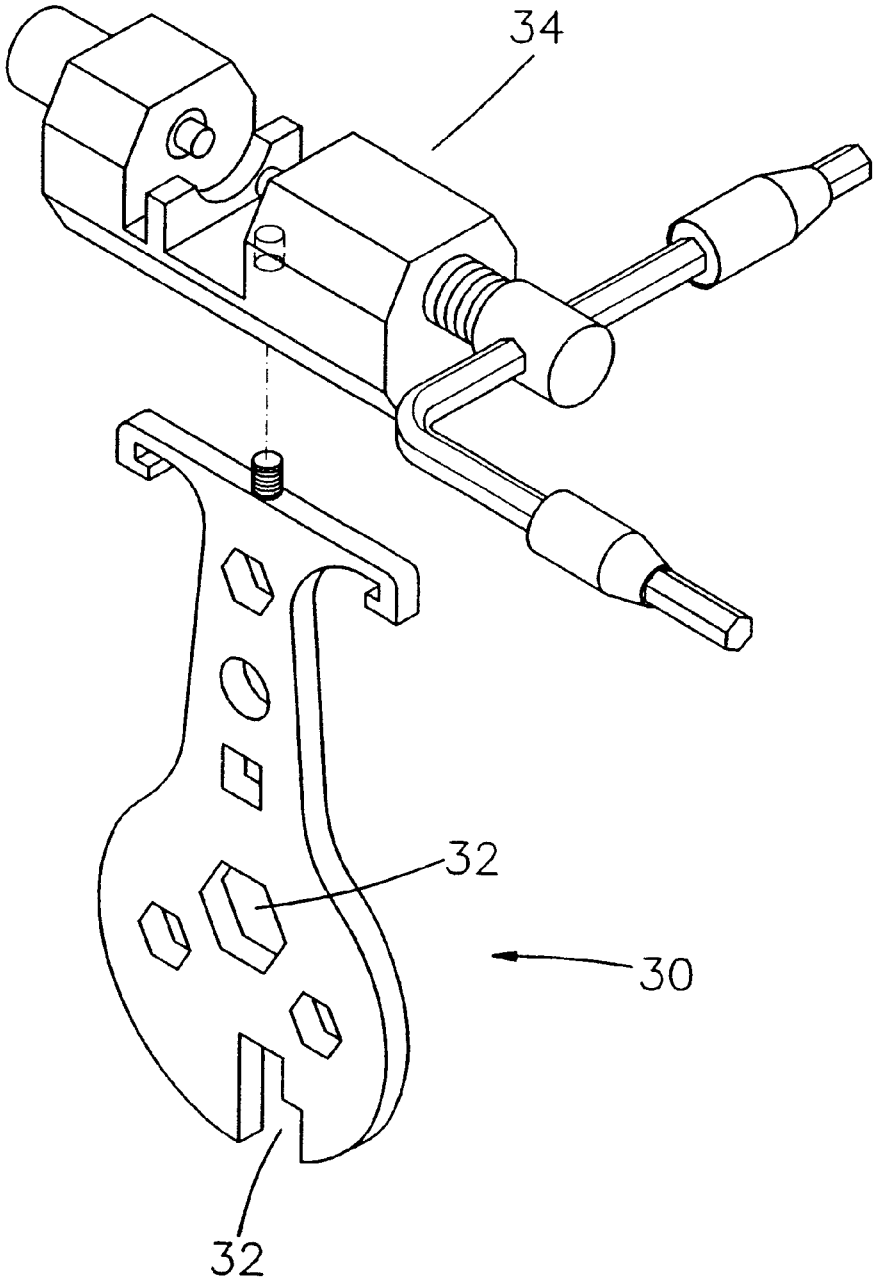
FIG. 3 PRIOR ART
FIG. 3 is a perspective exploded view of another conventional tool.
Figure 4:
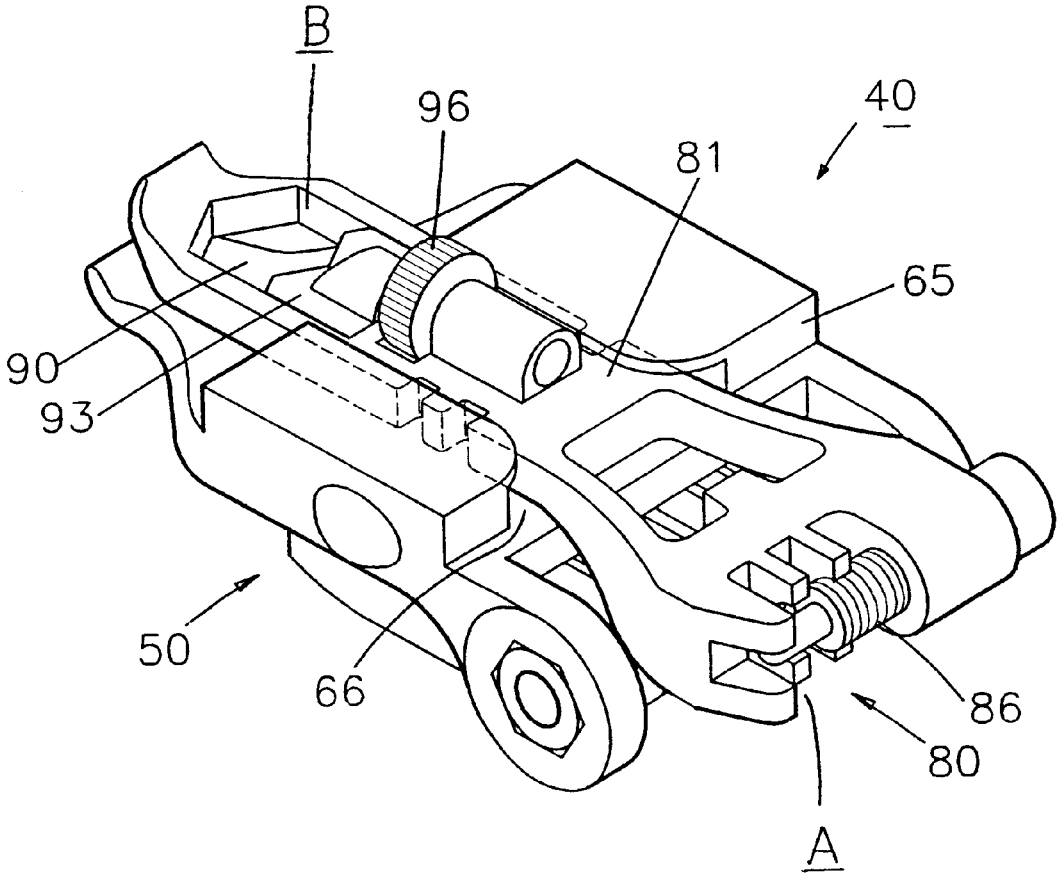
FIG. 4 is a perspective assembled view of a preferred embodiment of the present invention in a folded state.
Figure 5:
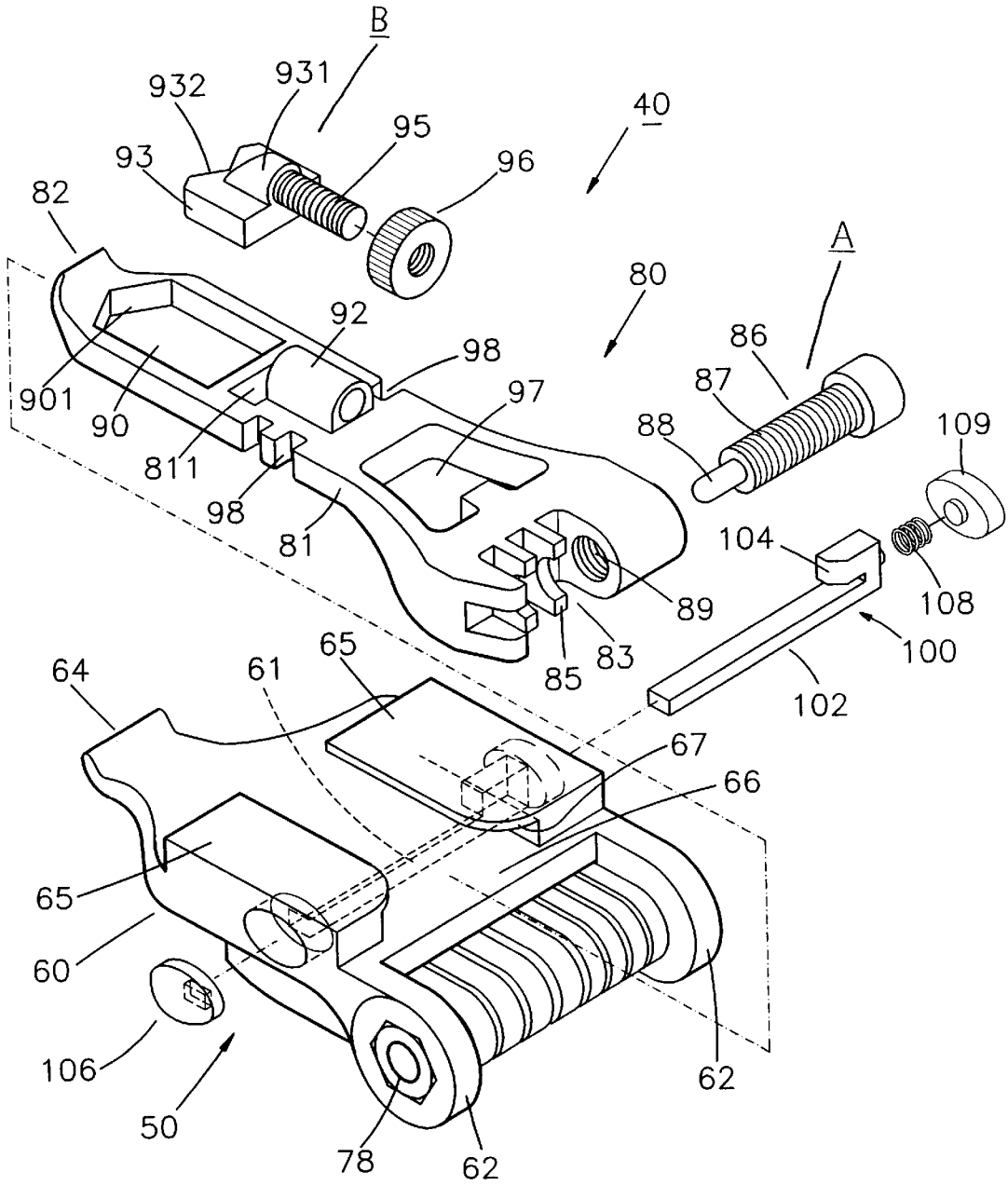
FIG. 5 is a perspective exploded view according to FIG. 4.

Please refer to FIGS. 4 and 5. According to a first embodiment, the complex tool kit 40 of the present invention includes two tool assemblies 50, 80.

Figure 6:
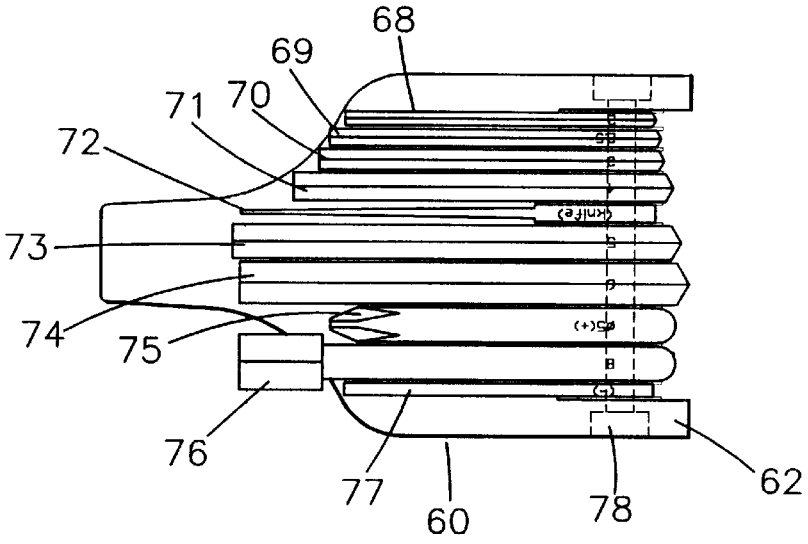
FIG. 6 is a bottom view of the foldable tool assembly of FIG. 4.

The tool assembly 50 is foldable, including a main body 60. The front end of the main body 60 is formed with two lugs 62. The rear end of the main body 60 is a hook-like insertion end 64. The top face of the main body 60 has a projection 65 formed with a passage 66. The passage 66 is axially parallel to the longitudinal length of the main body. The top face of the passage is open. The projection 65 has an inward extending wall section 67 partially covering the opening of the top face of the passage. Referring to FIG. 6, the foldable tool assembly 50 further has multiple tools 68~77 including 2, 2.5, 3, 4, 5, 6 and 8 mm hexagonal wrenches, a crosshead screwdriver, a flat head screwdriver and a blade. One end of each tool is formed as an arched pivot end. A screwed connecting member 78 is passed through the pivot ends of the tools 68~77 and pivotally connected between the lugs 62 of the main body 60 for folding and storing the tools.

The other tool assembly 80 is an adjustable wrench having an elongated flat board body 81. The rear end of the board body 81 is also a hook-like insertion end 82. The board body is provided with a chain-disassembling mechanism A and a clamping mechanism B. The chain-disassembling mechanism A includes a cavity 83 and an pushing member 86. The cavity 83 is inward recessed from front end of the board body 81. Two projecting walls 85 are disposed in the cavity 83 at intervals. The pushing member 86 has a thread rod section 87 and a pin section 88 formed at one end of the thread rod section 87. The thread rod section 87 is transversely movably screwed in a transverse thread hole 89 formed at front end of the board body 81, making the pin section 88 extend into the cavity 83.

The clamping mechanism B extends along the board body 81 from rear end to front end and sequentially includes a fitting slot 90, a through hole 811 and a projecting section 92 upward projecting from top face of the board body. The longitudinal length of the fitting slot 90 is parallel to the longitudinal length of the board body. A clamping member 93 is disposed in the fitting slot 90 and is slidable along the fitting slot 90. A front end of a thread rod 95 parallel to the longitudinal length of the board body extends into the projecting section 92. A rear end of the thread rod 95 is connected with a projecting section 931 formed on the clamping member 93. An rotary switch 96 formed with a thread hole is placed in the through hole 811 and screwed onto the thread rod 95. When screwing the rotary switch 96, the thread rod 95 is driven to move back and forth so as to further drive the clamping member 93 to slide within the fitting slot 90 and define a clamping hole adjustable in size. In addition, the board body 81 is formed with a cap-opening hole 97. Two sides of the board body are formed with several rectangular dents 98 with different sizes.

In use, the two tool assemblies 50, 80 are respectively fitted onto the hexagonal bolt and nut of a set of screwed connecting members. A hexagonal wrench with suitable size is selected from the foldable tool assembly 50 in accordance with the size of a bolt. The hexagonal wrench is fitted onto the bolt. Then, the fitting slot 90 of the tool assembly 80 is fitted onto a nut. The rotary switch 96 is rotated to move the clamping member 93, whereby the V-shaped clamping face 932 of the clamping member and the V-shaped clamping face 901 of the fitting slot 90 can together clamp the nut. Accordingly, an operator can respectively operate the tool assemblies 50, 80 with both hands to screw or unscrew bolts or nuts of a bicycle frame so as to adjust or detach parts.

Figure 7:
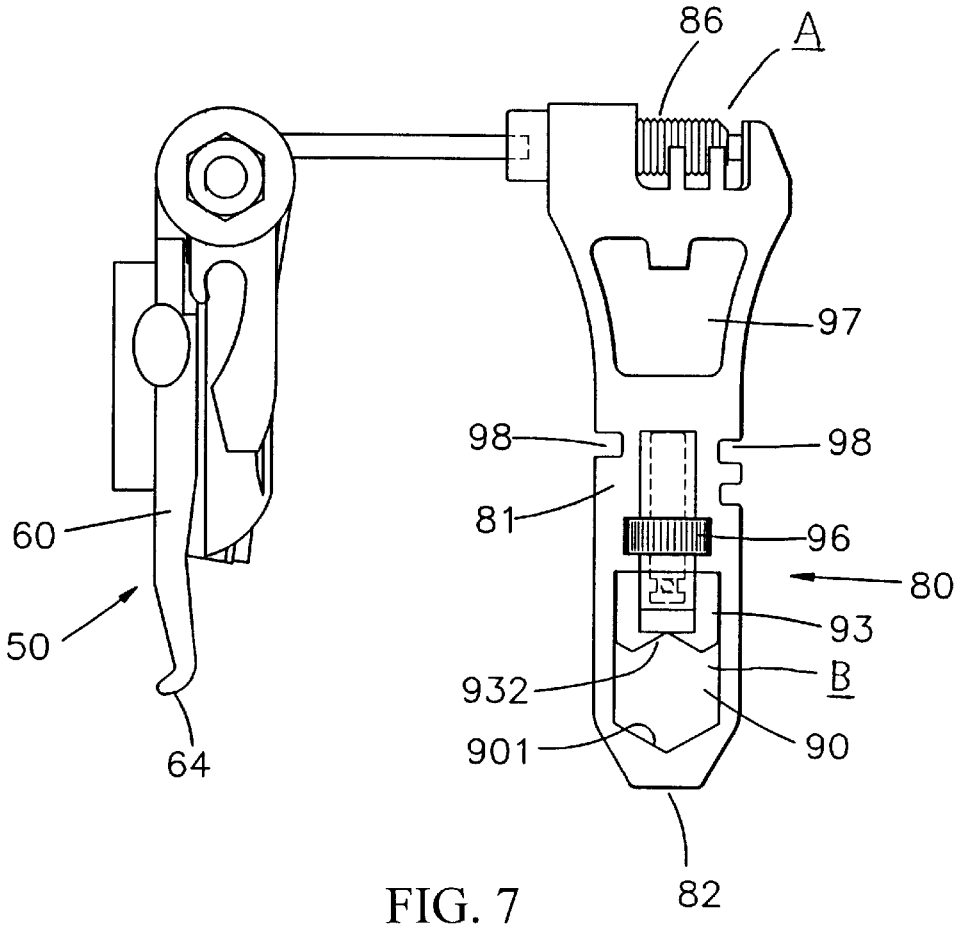
FIG. 7 shows the use of the present invention in one state.

The chain-detaching mechanism A of the tool assembly 80 is used to adjust the chain. The chain is placed in the cavity 83 and the pin section 88 of the pushing member 86 pushes the chain bolt of the chain so as to adjust the length of the chain. In use, an operator fits one hexagonal wrench of the foldable tool assembly 50 into a hexagonal hole (not shown) formed at outer end of the pushing member 86 as shown in FIG. 7. The operator holds the board body 81 with one hand and turn the foldable tool assembly 50 with the other hand so as to rotate the pushing member 86.

The insertion ends 64, 82 of the two tool assemblies 50, 80 can pry a tire away from the rim for repairing the tire. The dents 98 are used to adjust the spokes of the rim. The cap-opening hole 97 is used to open the cap of a bottle.

Figure 8:
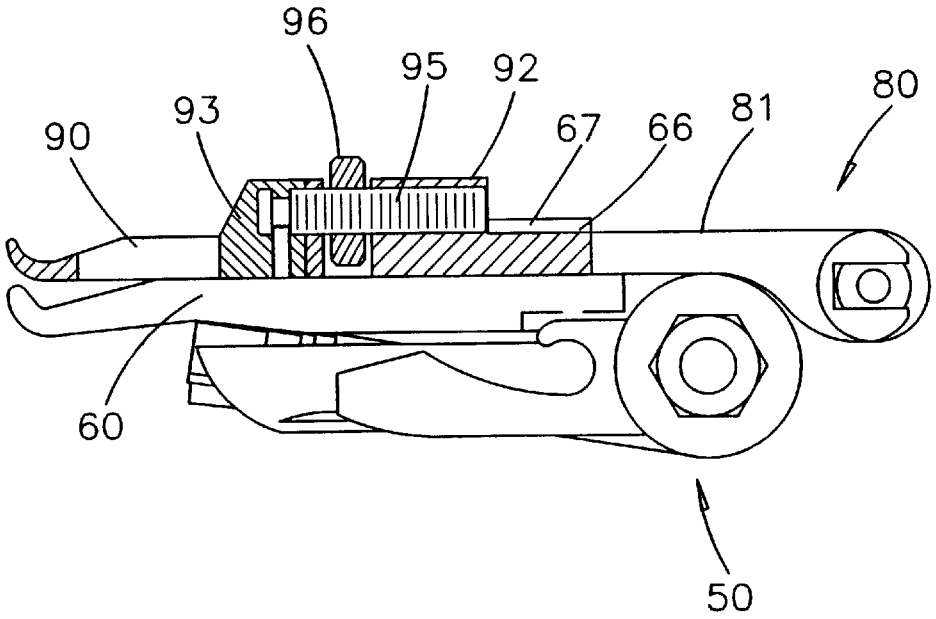
FIG. 8 is a partially longitudinally sectional view according to FIG. 4.
Figure 9:
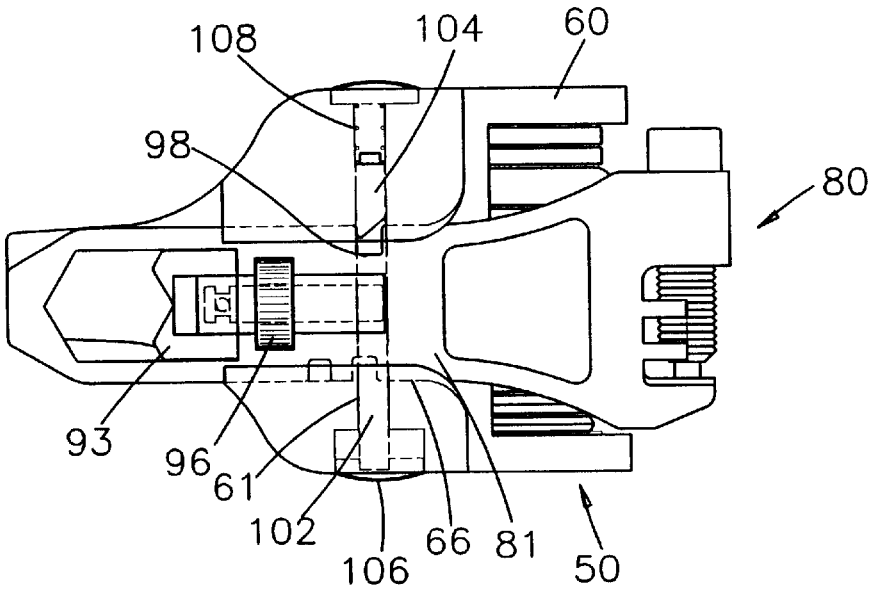
FIG. 9 is a top view according to FIG. 4.

After used, the board body 81 of the tool assembly 80 is inserted into the passage 66 of the foldable tool assembly 50 as shown in FIGS. 4, 8 and 9 to collect the complex tool kit 40. The wall section 67 serves to stop the board body 81 to prevent the tool assembly 80 from dropping out. Also, two side walls of the board body 81 are tightly fitted with two side walls of the passage 66 so that the board body is not easy to get out of the passage 66.

Figure 10:
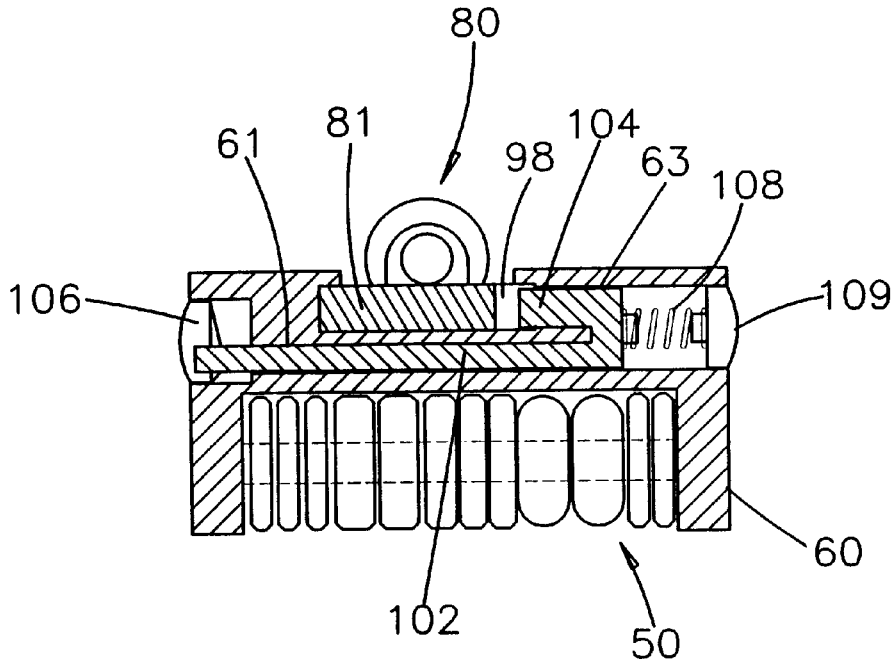
FIG. 10 is a cross-sectional view according to FIG. 4, showing the latched state of the present invention.

Alternatively, a latch device can be disposed between the two tool assemblies to achieve firmly engaging effect. As shown in FIGS. 5 and 10, the present invention further includes:

a latch device 100 having a latch member 102 and a resilient member 108. The latch member 102 is an elongated member one end of which is a latch section 104, while the other end of which is an operable controlling end 106. The latch member 102 is slidably fitted in a transverse tunnel 61 of the main body 60. The latch section 104 extends through a through hole 63 of the main body 60 into the passage 66. The controlling end 106 is positioned at one end of the tunnel 61 for a user to press. The resilient member 108 is placed in the tunnel 61. One end of the resilient member 108 abuts against a sealing cap 109, while the other end thereof resiliently abuts against the latch member 102.

In normal state, the latch member is resiliently pushed by the resilient member 108 toward one end of the tunnel 61 and kept in a latched position as shown in FIGS. 9 and 10. At this time, the latch section 104 extends into the passage 66. After the board body 81 is fitted into the passage 66, the latch section 104 is latched in a dent 98 of the board body to fix the board body.

Figure 11:
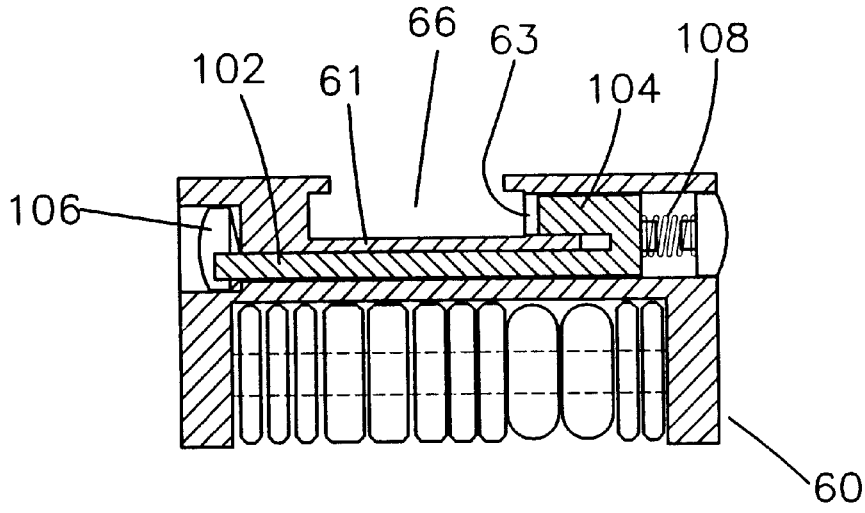
FIG. 11 is a view according to FIG. 10, showing that the tool assembly is unlatched and taken out.

When taking out the tool assembly 80, the controlling end 106 is pressed inward to make the latch member 102 slide toward the other end of the tunnel 61 into an unlatched position as shown in FIG. 11. At this time, the latch section 104 is drawn out of the passage 66 to unlatch the board body. Accordingly, the tool assembly 80 can be taken out for use.

It should be noted that one side of the board body 81 can be additionally formed with a dent instead of the dent 98 for the latch member to latch therein.

The above embodiments are only used to illustrate the present invention, not intended to limit the scope thereof. Many modifications of the above embodiments can be made without departing from the spirit of the present invention.

Figure 12:
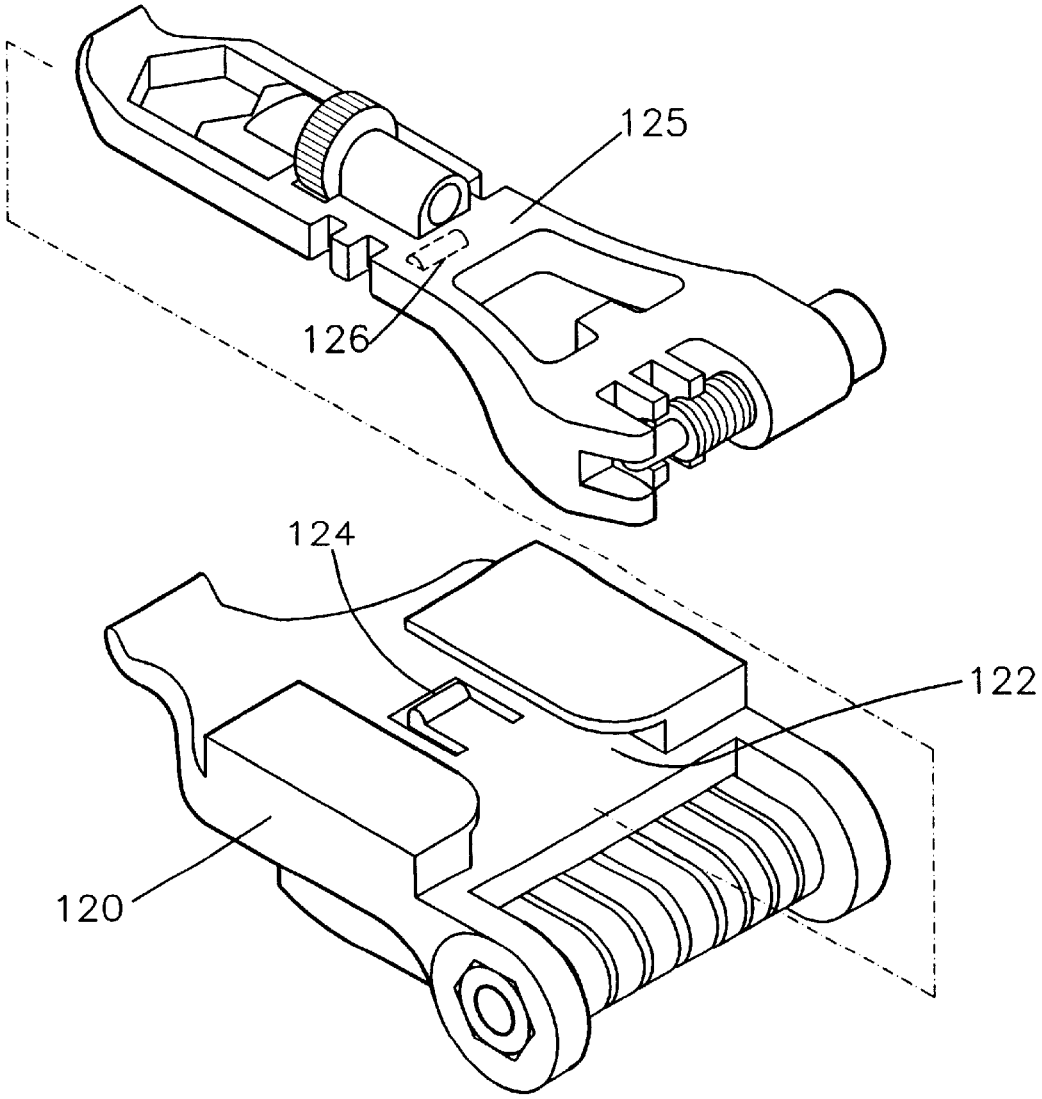
FIG. 12 is a perspective view of another embodiment of the present invention.

FIG. 12 shows a complex tool kit in which the latch device has a resilient latch member 124 disposed on bottom face of the passage 122 of the main body 120. The bottom face of the board body 125 is formed with a recessed section 126. When the board body 125 is fitted into the passage 122, the resilient member 124 is engaged with the recessed section 126.

Figure 13:
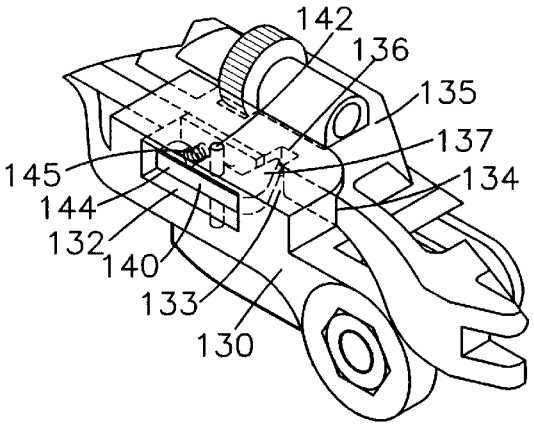
FIG. 13 is a perspective view of a part of still another embodiment of the present invention.

FIG. 13 shows still another embodiment of the present invention, in which a side wall of the main body 130 is formed with a recess 132. The latch device includes a latch member 140 and a resilient member 145. The body of the latch member 140 is pivotally connected in the recess 132 by a pivot shaft 142. The resilient member 145 is placed in the recess 132. Two ends of the resilient member 145 respectively abut against the inner wall of the recess and the latch member 140. When not subject to external force, the latch member is kept in a latched position. The latch section 137 at the other end of the latch member extends through a through hole 133 into the passage 134 to latch in a dent 136 of the board body 135. When the controlling end 144 of the other end of the latch member 140 is pressed, the latch member is moved to an unlatched position to unlatch the board body.

Figure 14:
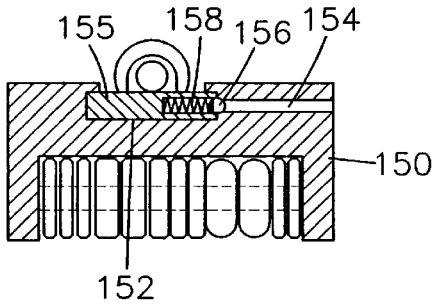
FIG. 14 is a sectional view of still another embodiment of the present invention.

In the complex tool kit of FIG. 14, the latch device includes a bead-like detent body 156 and a spring 158 embedded in a side wall of the board body 155. When the board body is fitted into the passage 152 of the main body 150, the detent body 156 is resiliently clicked into a dent 154 formed on inner wall of the passage so as to locate the board body.

Figure 15:
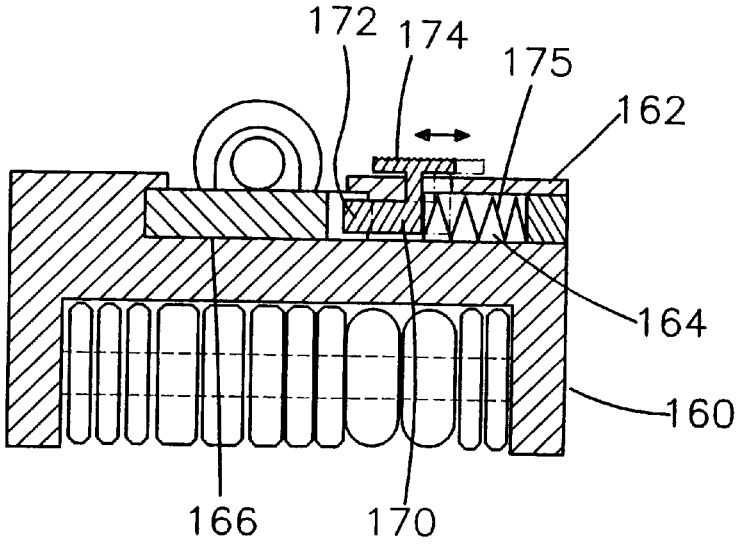
FIG. 15 is a sectional view of still another embodiment of the present invention.
Figure 16:
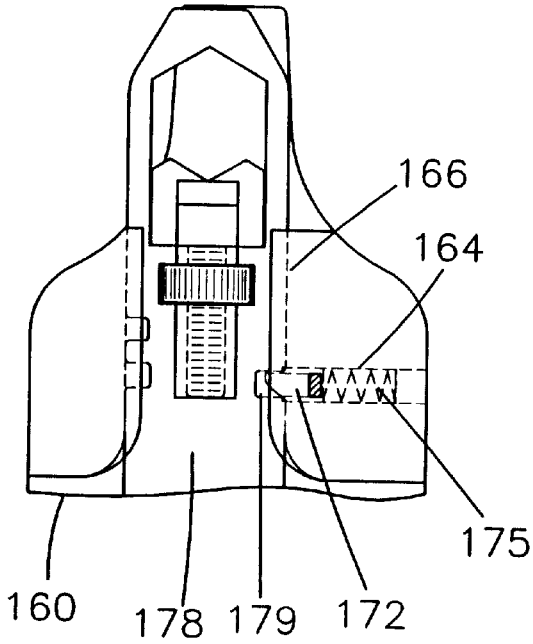
FIG. 16 is a top partially sectional view of the embodiment of FIG. 15.

FIGS. 15 and 16 show still another embodiment of the present invention, in which the projection 162 of the main body 160 is formed with a transverse tunnel 164 communicating with the passage 166. The latch device includes a latch member 170 and a resilient member 175. One end of the latch member is a latch section 172, while the other end thereof is an operable controlling end 174. The latch section 172 is received in the tunnel 164, while the controlling end 174 protrudes out of the main body 160. The resilient member 175 is disposed in the tunnel 164 to resiliently push the latch member 170. When not subject to external force, the latch member is pushed by the resilient member 175 and positioned in a latched position where the latch section 172 extends into the passage 166 to latch in a dent 179 of the board body 178. When the controlling end 174 is outward shifted, as shown by phantom line of FIG. 15, the latch member 170 is moved to an unlatch position to unlatch the board body 178.

Figure 17:
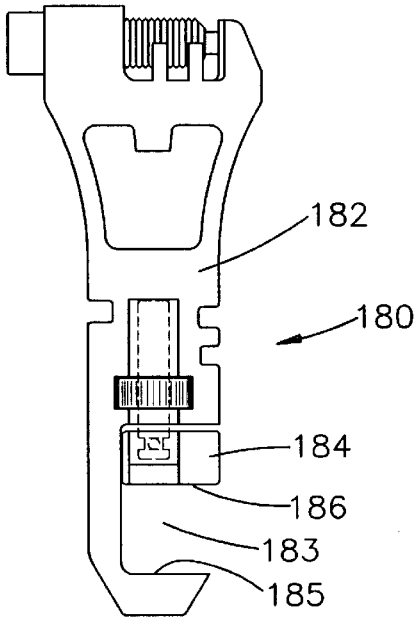
FIG. 17 is a top view of still another embodiment of the present invention.

FIG. 17 shows still another embodiment of the present invention, which has a structure substantially identical to that of the first embodiment. This embodiment also includes a foldable tool assembly and another tool assembly 180. The foldable tool assembly is structurally identical to the first embodiment and thus is not shown. The tool assembly 180 is also substantially structurally identical to the first embodiment. The difference therebetween is that the fitting slot 183 formed on the board body 182 is open on one side. One side of the clamping member 184 attaches to the other side of the fitting slot 183 and is longitudinally movable along the fitting hole. The clamping member 184 and the fitting hole 183 can be formed with straight clamping faces 185, 186 for clamping opposite sides of a nut.

The present invention has the following advantages:

1. The tool assembly 80 has a flat shape which can be collectively fitted with the foldable tool assembly 50 to reduce the volume for easy storage. The board body 81 of the tool assembly 80 is directly fitted into the passage 66 of the foldable tool assembly so that the two tool assemblies can be easily connected.
2. The hexagonal wrenches are totally arranged in the foldable tool assembly 50 for specifically driving the bolts of the bicycle frame. The tool assembly 80 is fitted onto a nut. Therefore, the bolt and nut of each set of screwed connecting members can be at the same time truly tightened or untightened by the two tool assemblies 50, 80.
3. The sizes of the hexagonal wrenches of the foldable tool assembly 50 totally conform with various sizes of hexagonal bolts of the bicycle frame. The clamping mechanism B of the tool assembly 80 is adjustable in size so that it is adaptable to various sizes of nuts of the bicycle frame. Therefore, the present invention is applicable to all sizes of bolts and nuts of the bicycle frame.

What is claimed is:

1. Complex tool kit comprising a foldable tool assembly and a second tool assembly, wherein:

the foldable tool assembly includes:

a main body having a predetermined width, a top face of the main body being formed with a passage; and a plurality of tools including different sizes of hexagonal wrenches, one end of the tools being pivotally connected with a first end of the main body, whereby the tools can be folded about the pivot end and collectively arranged under a bottom face of the main body; and the second tool assembly includes:

an elongated flat board body, one end of the board body being formed with a cavity, one side of the cavity having a thread hole normal to a longitudinal length of the board body, the thread hole communicating with the cavity;

a pushing member rotatably and movably screwed in the thread hole, such that one end of the pushing member could extend into the cavity;

a fitting slot formed on the board body, a longitudinal length of the fitting slot being parallel to the longitudinal length of the board body, a first end of the fitting slot being formed with a first clamping face;

a clamping member positioned in the fitting slot and slidable along the fitting slot, a first end of the clamping member being formed with a second clamping face opposite to the first clamping face of the fitting slot;

a thread rod disposed on the board body in parallel to the longitudinal length of the board body, a first end of the thread rod being connected with a second end of the clamping member;

a rotary switch connected with a second end of the thread rod, whereby when the rotary switch is rotated, the thread rod drives the clamping member to slide within the fitting slot so as to change the distance between the first and second clamping faces;

the board body of the second tool assembly being detachably fitted into the passage of the main body to connect the second tool assembly with the foldable tool assembly; and a latch device disposed between the main body and the board body, whereby when the board body is fitted into the passage, the latch device is latched with the board body to prevent the second tool assembly from dropping out of the passage, the latch device being manually operable to unlatch the board body.

2. Complex tool kit as claimed in claim 1, wherein the axis of the passage is parallel to the longitudinal length of the main body.

3. Complex tool kit as claimed in claim 1, wherein two sides of the board body are engaged with two sides of the passage by tight fit.

4. Complex tool kit as claimed in claim 1, wherein a top face of the passage has an opening, the opening having at least one wall section partially covering the opening.

5. Complex tool kit as claimed in claim 1, wherein a projection is formed on the top face of the main body and the passage is formed in the projection.

6. Complex tool kit as claimed in claim 1, wherein the board body is formed with a through hole adjacent to a second end of the fitting slot, the rotary switch being positioned in the through hole.

7. Complex tool kit as claimed in claim 1, wherein a second end of the main body and a second end of the board body are respectively formed with insertion ends.

8. Complex tool kit as claimed in claim 1, wherein the board body is formed with a cap-opening hole.

9. Complex tool kit as claimed in claim 1, wherein two sides of the board body are formed with predetermined number of dents.

10. Complex tool kit as claimed in claim 1, wherein the latch device includes a latch member and a resilient member, the latch member being disposed in the main body and movable between a latched position and an unlatched position, in the latched position, the latch member extending into the passage to latch with the board body, in the unlatched position, the latch member being moved out of the passage, the resilient member being positioned between the main body and the latch member to resiliently keep the latch member in the latched position.

11. Complex tool kit as claimed in claim 10, wherein the main body is formed with a transverse tunnel communicating with the passage, one end of the latch member being formed with a latch section, while the other end thereof being formed as an operable controlling end, the latch member being slidably fitted in the tunnel, the resilient member resiliently pushing the latch member to keep the latch section extending into the passage, the controlling end being positioned on one side of the main body, whereby when the controlling end is manually pressed, the latch member is moved to the unlatched position and the latch section is moved out of the passage.

12. Complex tool kit as claimed in claim 10, wherein a side wall of the main body is formed with a recess having therein a through hole communicating with the passage, one end of the latch member being formed with a latch section pivotally connected in the recess and rotatable between a latched position and an unlatched position, the latch section corresponding to the through hole, the resilient member being placed in the recess to push the latch member and make the latch section extend from the through hole into the passage.

13. Complex tool kit as claimed in claim 1, wherein the latch device includes a resilient latch member disposed on bottom face of the passage of the main body, the bottom face of the board body being formed with a recessed section, whereby when the board body is fitted into the passage, the resilient latch member is engaged in the recessed section.

14. Complex tool kit as claimed in claim 1, wherein a dent is formed on an inner wall face of the passage, and wherein the latch device includes a detent body and a spring embedded in the board body, the detent body being pushed by the spring and partially exposed to outer side of the board body, whereby when the board body is fitted into the passage, the detent body is resiliently clicked into the dent.

15. Complex tool kit as claimed in claim 1, wherein the fitting slot formed on the board body is open on one side.

16. Complex tool kit comprising a foldable tool assembly and an adjustable wrench, wherein:

the foldable tool assembly includes:

a main body, a top face of the main body being formed with a passage; and a plurality of tools including different sizes of hexagonal wrenches, one end of the tools being pivotally connected with a first end of the main body, whereby the tools can be folded about the pivot end and collectively arranged under a bottom face of the main body; and the adjustable wrench includes:

an elongated flat board body;

a clamping mechanism disposed on the board body, the clamping mechanism defining a clamping hole adjustable in size for fitting onto a nut;

the board body of the adjustable wrench being detachably fitted into the passage of the main body and connected with the foldable tool assembly; and a latch device disposed between the main body and the board body, whereby when the board body is fitted into the passage, the latch device releasably latches the main body with the board body.

17. Complex tool kit as claimed in claim 16, wherein the clamping mechanism includes:

a fitting slot formed on the board body, a longitudinal length of the fitting slot being parallel to a longitudinal length of the board body, a first end of the fitting slot being formed with a clamping face;

a clamping member positioned in the fitting slot and slidable along the fitting slot, a first end of the clamping member being formed with a second clamping face opposite to the first clamping face of the fitting slot;

a thread rod disposed on the board body in parallel to the longitudinal length of the board body, a first end of the thread rod being connected with a second end of the clamping member; and a rotary switch connected with a second end of the thread rod, whereby when the rotary switch is rotated, the thread rod drives the clamping member to slide within the fitting slot so as to change the distance between the first and second clamping faces.

18. Complex tool kit as claimed in claim 16, wherein a projection is formed on the top face of the main body and the passage is formed in the projection.

19. Complex tool kit comprising a foldable tool assembly and another tool assembly, wherein:

the foldable tool assembly includes:

a main body, a top face of the main body being formed with a passage; and a plurality of tools including a predetermined number of different sizes of hexagonal wrenches, one end of the tools being pivotally connected with a first end of the main body, whereby the tools can be folded and collectively arranged under a bottom face of the main body or outward unfolded for use; and the second tool assembly includes:

an elongated flat board body;

a chain-disassembling mechanism disposed at one end of the board body for disassembling/assembling a chain;

the board body of the second tool assembly being detachably fitted into the passage of the main body and connected with the foldable tool assembly; and a latch device disposed between the main body and the board body, whereby when the board body is fitted into the passage, the latch device releasably latches the main body with the board body.

20. Complex tool kit as claimed in claim 19, wherein the chain-disassembling mechanism includes:

a cavity being formed on one end of the board body, one side of the cavity having a thread hole normal to a longitudinal length of the board body, the thread hole communicating with the cavity;

a pushing member rotatably and movably screwed in the thread hole.

21. Complex tool kit as claimed in claim 19, wherein a projection is formed on the top face of the main body and the passage is formed in the projection.

22. Complex tool kit comprising a foldable tool assembly and an adjustable wrench, wherein:

the foldable tool assembly includes:

a main body, a top face of the main body being formed with a passage; and several tools including a predetermined number of different sizes of hexagonal wrenches, one end of the tools being pivotally connected with one end of the main body, whereby the tools can be folded and collectively arranged under bottom face of the main body or outward unfolded for use; and the adjustable wrench includes:

an elongated flat board body;

a chain-disassembling mechanism disposed at one end of the board body for disassembling/assembling a chain; and a clamping mechanism disposed on the board body, the clamping mechanism defining a clamping hole adjustable in size for fitting onto a nut;

the board body of the adjustable wrench being detachably fitted into the passage of the main body and connected with the foldable tool assembly.

23. Complex tool kit as claimed in claim 22, wherein a projection is formed on top face of the main body and the passage is formed in the projection.

24. Complex tool kit as claimed in claim 22, further comprising a latch device disposed between the main body and the board body, whereby when the board body is fitted into the passage, the latch device unlatchably latches the main body with the board body.

* * * * *